United States Patent [19]

Fann et al.

[11] Patent Number: 4,760,722

[45] Date of Patent: Aug. 2, 1988

[54] CYLINDER LOCK

[75] Inventors: Yaw-Shin Fann, Chiayi; Rong-Faa Wu, Chiayi Hsien, both of Taiwan

[73] Assignee: Tong Lung Metal Industry Co. Ltd., Chiayi, Taiwan

[21] Appl. No.: 52,382

[22] Filed: May 21, 1987

[51] Int. Cl.[4] ..... E05B 27/02

[52] U.S. Cl. ..... 70/358; 70/378

[58] Field of Search ..... 70/358, 359, 364 A, 70/376, 378

[56] References Cited

U.S. PATENT DOCUMENTS 1,095,500 5/1914 Hansen ..... 70/359

3,393,542 7/1968 Crepinsek ..... 70/358

FOREIGN PATENT DOCUMENTS 258153 11/1967 Australia ..... 70/358

2113008 10/1971 Fed. Rep. of Germany ..... 70/358

*Primary Examiner*—Robert L. Wolfe

*Attorney, Agent, or Firm*—Breneman & Georges

[57] ABSTRACT

A cylinder lock which includes pin-tumblers to lock a cylinder against rotation relative to a housing, wherein the pin-tumblers and tumbler bores are arranged such that the axes thereof lie in different parallel longitudinal planes normal to a diametrical plane of the cylinder and each tumbler bore receives a plurality of pin-tumblers.

17 Claims, 8 Drawing Sheets

CYLINDER LOCK

BACKGROUND OF THE INVENTION

This invention relates to a cylinder lock and particularly to a cylinder lock in which pin-tumblers which are urged by springs in one direction are arranged such that the axes thereof lie in different parallel planes normal to a diametrical plane of a rotary cylinder.

Cylinder locks with pin-tumblers are known in the art. In order to improve the security of cylinder locks, improvements have been made in the constructions thereof so as to make the locks difficult to pick. U.S. Pat. No. 4,142,389 discloses a cylinder lock in which each tumbler of the housing of the lock is made of two parts, one part telescopically slidable within the other, both parts being urged by springs against a corresponding tumbler received in the rotating cylinder which corresponding tumbler is likewise made of two telescopic parts. The key to operate the lock has concentric projections or recesses on a planar face of the key. Such a lock increases the positions, permutations, and combinations of the pin-tumblers so that the lock will be more difficult to pick than other known locks which do not comprise telescopic pin-tumblers. However, the above-mentioned lock still can be picked if one uses more time than is necessary to pick those with non-telescopic pin-tumblers, since the axes of the telescopic pin-tumblers are aligned on a single longitudinal plane of the cylinder as in other known cylinder locks.

SUMMARY OF THE INVENTION

An object of the invention is to provide an improved cylinder lock which is more difficult to pick than the above-mentioned locks.

According to the invention, a cylinder lock is provided with pin-tumblers which are arranged such that the axes of the pin-tumblers lie in different parallel longitudinal planes normal to a diametrical plane of the rotatry cylinder of the lock. The variable positions as well as the combinations of the pin-tumblers of the invention are increased when compared with the lock disclosed in U.S. Pat. No. 4,142,389. A key to operate the lock has projections and recesses on at least one planar face of the key.

In one aspect of the invention, the pin-tumblers are arranged in more than one group. The axes of the pin-tumblers in each group are parallel to each other but incline with the axes of the pin-tumblers of the other groups. The key to operate the lock has projections and recesses on more than one planar face of the key.

In another aspect of the invention, the pin-tumblers in each group are arranged in a plurality of sub-groups. The pin-tumblers of each sub-group are adjacent parallelly to each other but are spaced apart from the pin-tumblers of the other sub-groups. Each sub-group is arranged in each tumbler bore of the lock.

The exemplary preferred embodiments of the invention will be described in detail with reference to the following drawings, in which:

DETAILED DESCRIPTION OF THE PREFERRED EMBODIMENTS

Figure 1:
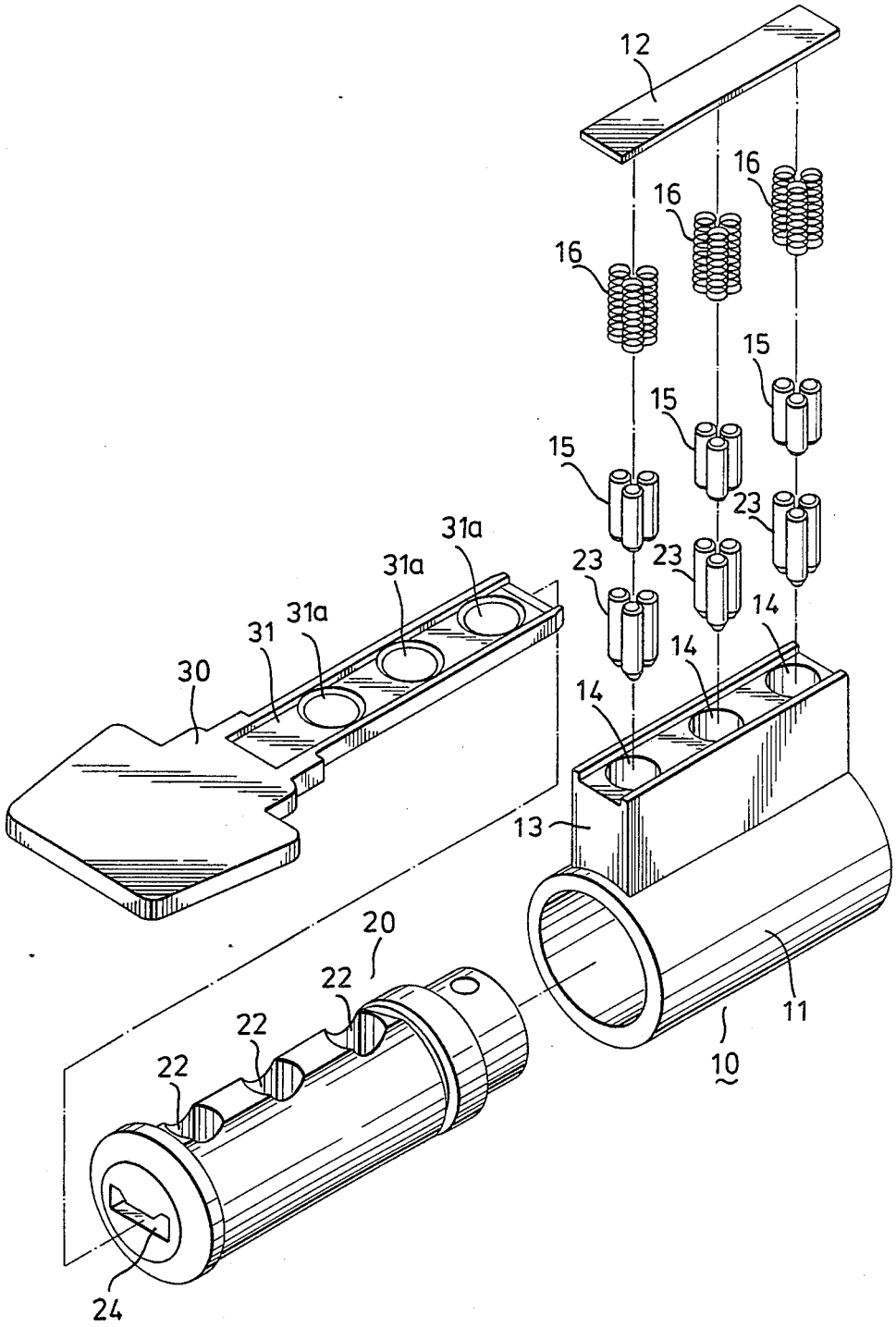
FIG. 1 is an exploded view of a first embodiment of the invention.

The preferred embodiments of the present invention are illustrated in the drawings in which the same elements are represented by the same reference numerals.

Figure 2:
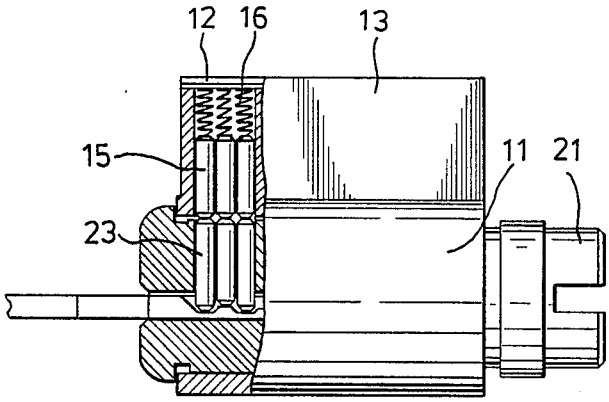
FIG. 2 is a partially sectioned view of the first embodiment.

Referring to FIGS. 1 and 2, a first embodiment of a cylinder lock is shown, having a housing 10, and a cylindrical body 20 mounted rotatably in the housing 10. The housing 10 is constituted of a hollow cylinder 11 and an extension housing 13 of rectangular cross-section extending radially from the periphery of the cylinder 11. The extension housing 13 is provided with three axially aligned tumbler bores 14 of circular cross-section, and a group of pin-tumblers 15 whose axes lie in different parallel longitudinal planes normal to a diametrical plane of the cylinder 11. The pin-tumblers 15 are arranged in three sub-groups each having three pin-tumblers 15 adjacent laterally to each other in a triangular arrangement and received in each bore 14.

The cylindrical body 20 is provided with three tumblers bores 22 which are aligned with the bores 14. In each bore 22 are placed three pin-tumblers 23 which are aligned with the pin-tumblers 15. Springs 16 are provided in the bores 15 and each spring 16 urges each pin-tumblers 15 to cause the pin-tumblers 15 to extend into the bores 14, thereby preventing the cylinder 20 to rotate relative to the housing 11. At the rear end of the cylindrical body 20 is a bolt 21 which, upon rotation, will cause a latch (not shown) to retract or extend. Numeral 12 represents a cover plate to cover the extension housing 13.

There is a key hole 24 in the cylinder 20 as in conventional cylinder locks. A key 30 is provided to operate the pin-tumblers 23 so as to move the pin-tumblers 15 out of the bores 22. The key 30 has two opposite planar faces 31 on one of which are provided three circular recesses **31*a* to align the ends of the pin-tumblers 23**. It can be appreciated that the key to be incorporated in the present invention must have operating projections or recesses located on a planar face of the key rather than located linearly or on an edge of the key since the pin-tumblers do not lie in a single longitudinal plane of the cylinder.

Figure 3:
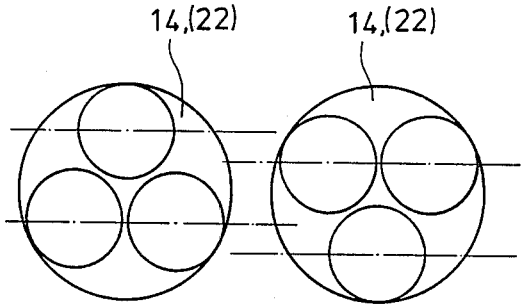
FIG. 3 shows an alternative arrangement of sub-groups of pin-tumblers for the first embodiment.
Figure 4:
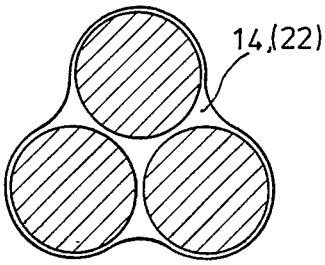
FIG. 4 shows an alternative tumbler bore to be incorporated in the first embodiment.
Figure 5:
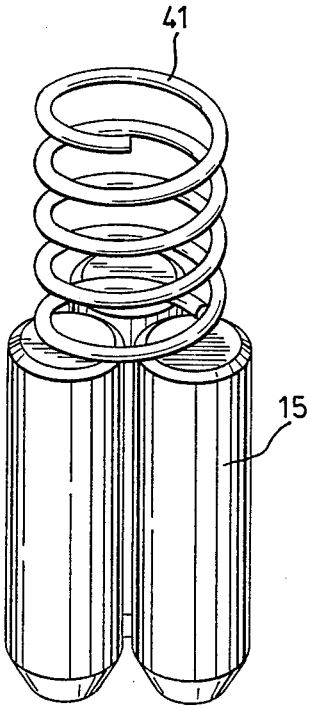
FIG. 5 shows an alternative spring to be incorporated in the first embodiment.
Figure 6:
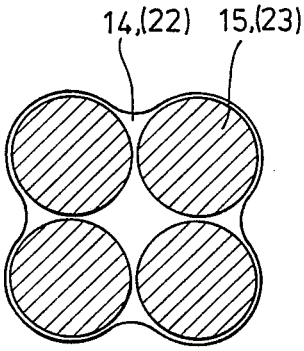
FIG. 6 shows another alternative arrangement of pin-tumblers for the first embodiment.

While the cross-section of each bore 14 or 22 is circular as described above, it may have a cross-section with a contour substantially conforming to the contour of the cross-section of the pin-tumblers 15 or 23 when they are bundled, i.e. a contour formed of three overlapping circles as shown in FIG. 4. The bores 14 or 22 can be arranged in such a manner that the axes thereof do not lie in the same plane as shown in FIG. 3. Moreover, the three springs 16 which urge the three pin-tumblers 15 to extend into the bores 23 may be replaced with a single spring 41 which urges the same simultaneously as shown in FIG. 5. In addition, each sub-group of three pin-tumblers 15 or 23 can be replaced with a sub-group having four pin-tumblers 15 or 23 arranged as shown in FIG. 6.

Figure 7:
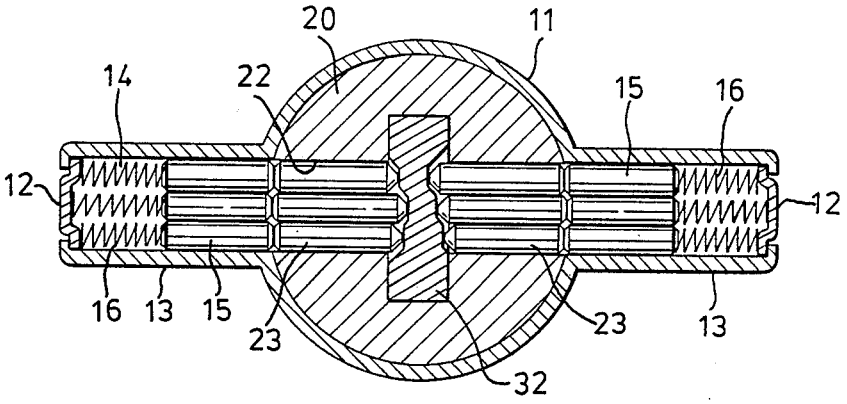
FIG. 7 shows a second embodiment of the present invention.

FIG. 7 shows a second embodiment of the invention which is substantially similar to the first embodiment except for that it includes two groups of pin-tumblers 15 and two groups of pin-tumblers 23 received in two groups of bores 14 and 22. The axes of the pin-tumblers 15 or 22 in each group are parallel to each other but incline by 180 degs to the axes of the pin-tumblers 15 or 22 of another group. A key 32 to operate the lock has on both planar faces projections and recesses to operate the two groups of pin-tumblers.

Figure 8:
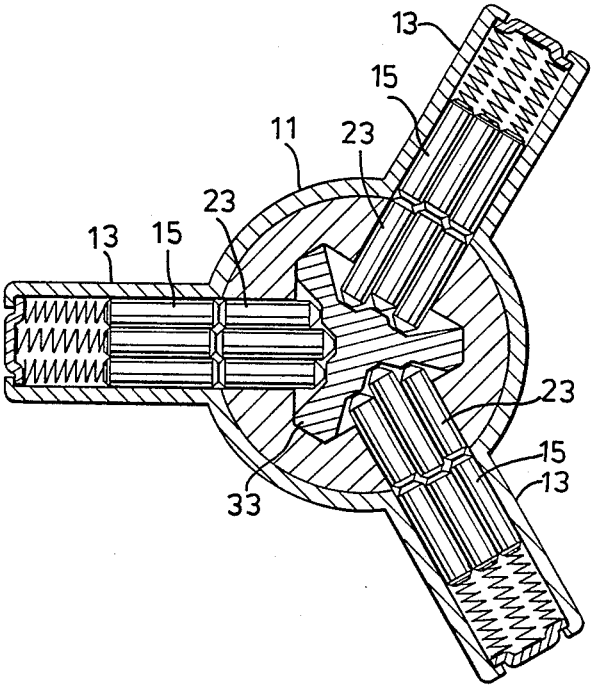
FIG. 8 shows a third embodiment of the present invention.

FIG. 8 shows a third embodiment of the invention in which three groups of the pin tumblers 15 and 23 and three groups of tumbler bores 14 and 22. The axes of the pin-tumblers in each group incline substantially by 120 degs to the axes of the pin-tumblers of the other groups. A key 33 to operate the lock has three planar faces having projections and recesses to operate the three groups of the pin-tumblers.

Figure 9:
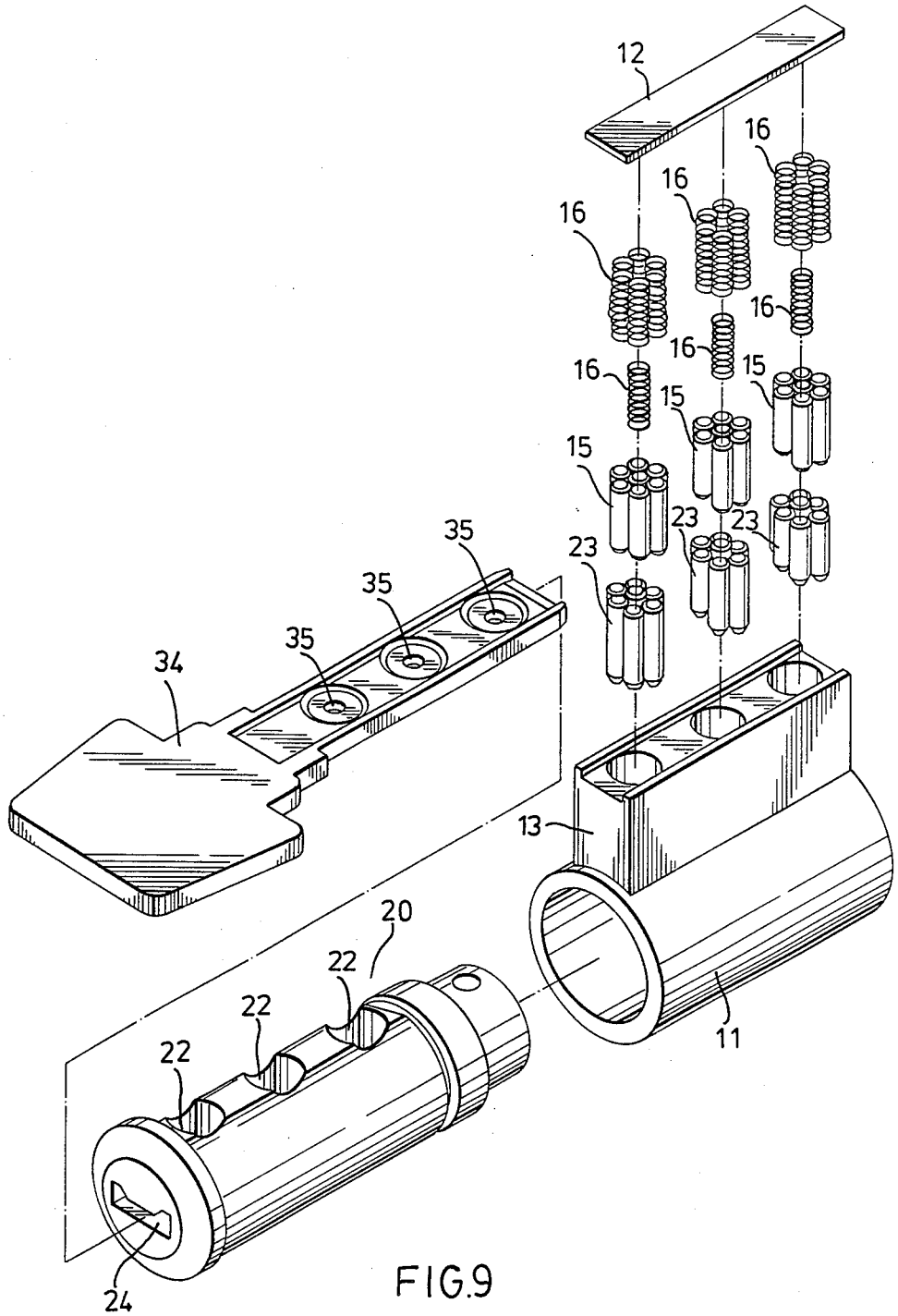
FIG. 9 shows a fourth embodiment of the present invention.

FIG. 9 shows a fourth embodiment which differs from the first embodiment in that each sub-group of pin-tumblers 15 includes a central pin-tumbler 15 and six surrounding pin-tumblers 15. The corresponding pin-tumblers 23 are arranged likewise. The central pin-tumblers 15 and 23 are urged by one of springs 16 in such a manner that they extend in greater length than do the surrounding pin-tumblers. A key 34 to operate the lock has three sets of concentric recesses 35 to operate the pin-tumblers.

Figure 10:
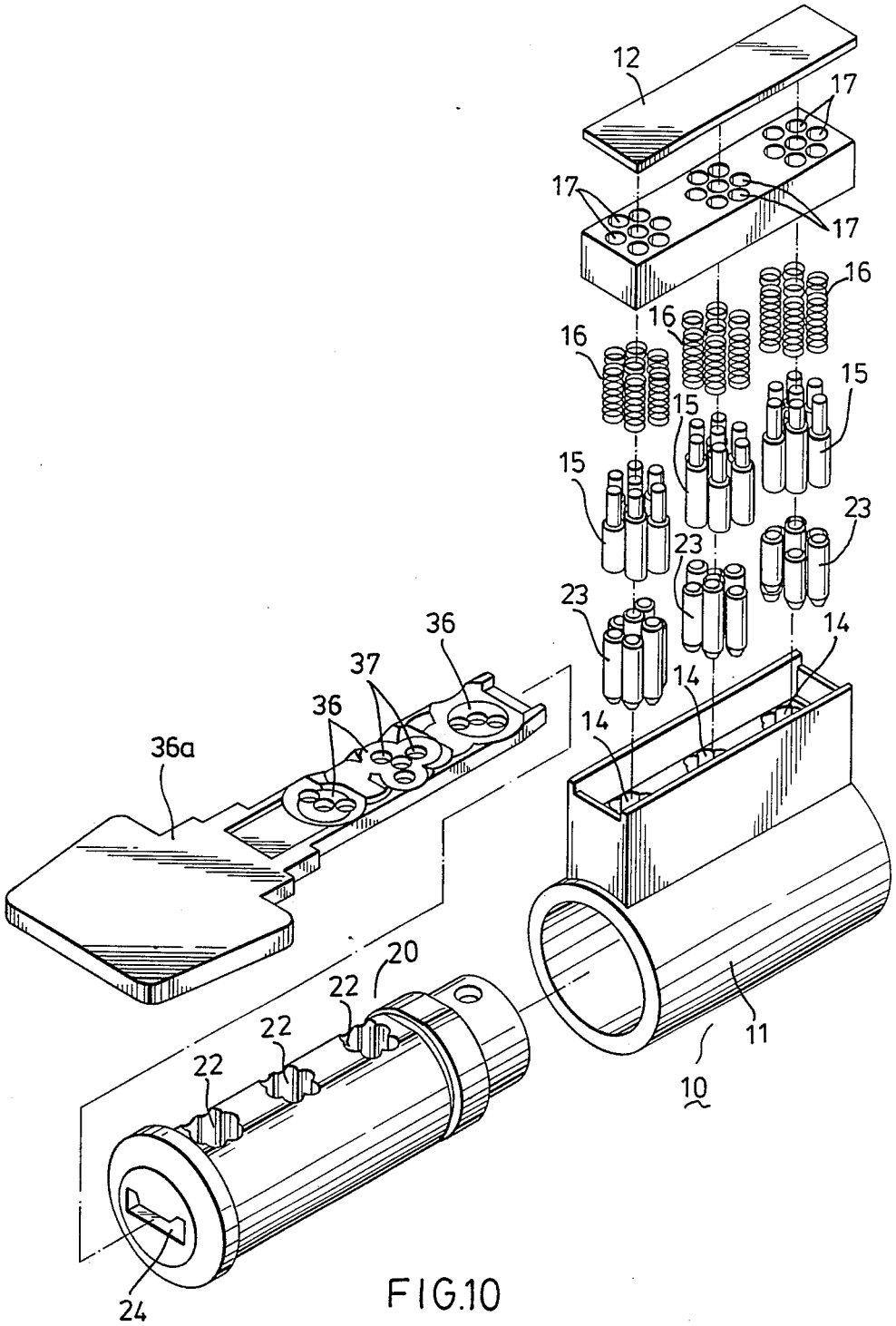
FIG. 10 shows a fifth embodiment of the present invention.

FIG. 10 shows a fifth embodiment which differs from the first embodiment in that each sub-group of pin-tumblers includes seven pin-tumblers 15 or 23. In the extension housing 13 of the lock housing 10 is provided a preforated guide plate 18 having three groups of guide holes 17 each for receiving each pin-tumbler 15 of each sub-group. With this preforated guide plate 18, the pin tumblers 15 can be kept in a proper alignment in the tumbler bores 14. A key **36*a* to operate the lock has three larger recesses 36 each having therein a plurality of smaller recesses 37**.

Figure 11:
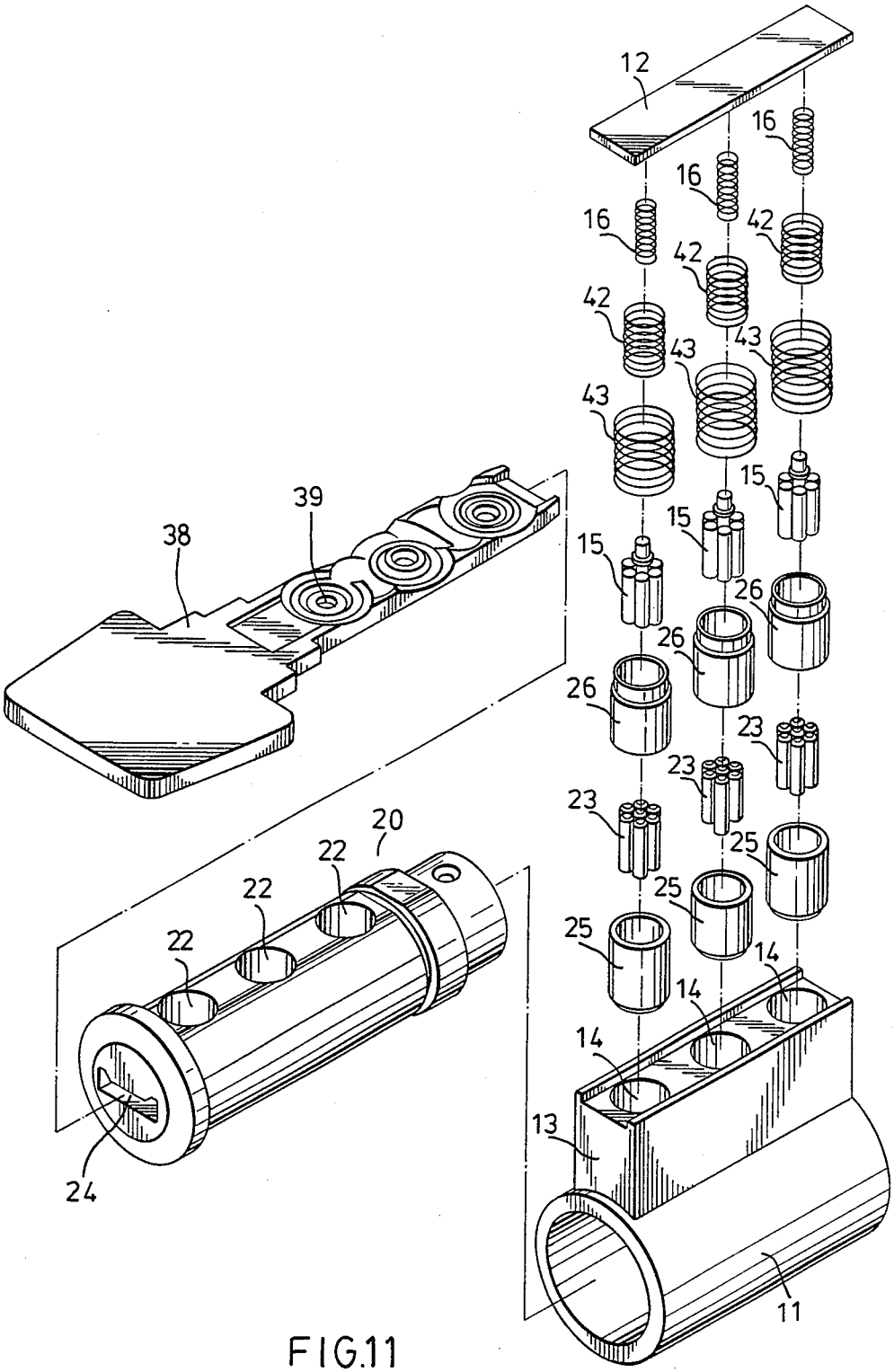
FIG. 11 shows a sixth embodiment of the present invention.

FIG. 11 shows a sixth embodiment in which each sub-group of pin-tumblers 15 includes a central pin-tumbler 15 and six surrounding pin-tumblers 15 which are received telescopically in a sleeve 26. Each sub-group of pin-tumblers 23 includes, likewise, a central pin-tumbler 23 and six surrounding pin-tumblers 23 which are received telescopically in a sleeve 25. The urging means includes an innermost spring 16 for the central pin-tumblers 15, an intermediate spring 42 for urging the surrounding pin-tumblers 15 and an outermost spring 43 for urging the sleeve 26. A key 38 to operate the lock has three sets of concentric recesses 39 on its planar face.

Figure 12:
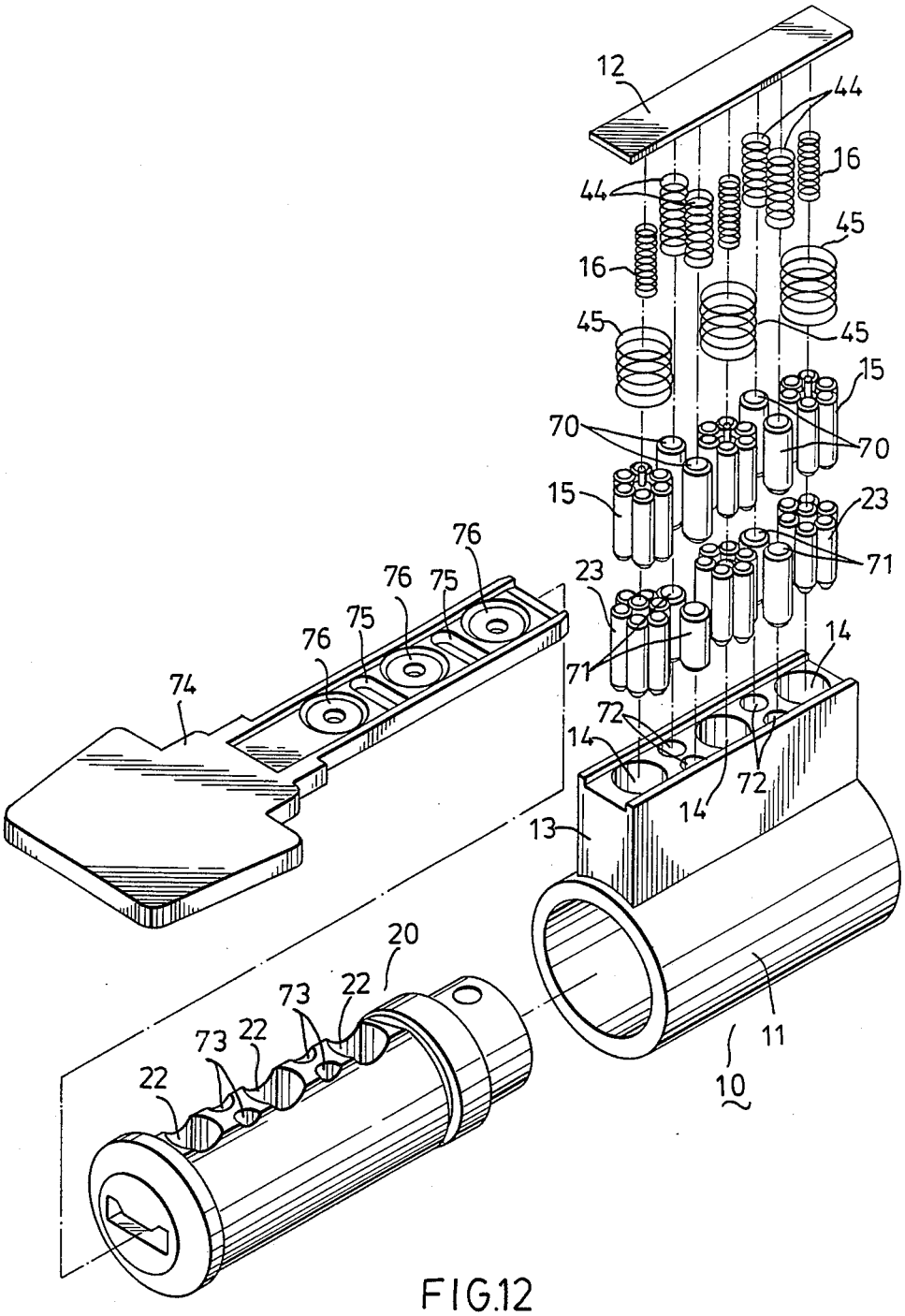
FIG. 12 shows a seventh embodiment of the present invention.

FIG. 12 shows a seventh embodiment which includes pin-tumblers 70 and 71 in addition to three sub-groups of seven pin-tumblers 15 and three sub-groups of seven pin-tumblers 23. Each pair of pin-tumblers 70 or 71 are disposed between two adjacent sub-groups of the pin-tumblers 15 or 23. The extension housing 13 of the lock housing 10 comprises three tumbler bores 14 and additional bores 72 for receiving the pin-tumblers 70. The cylinder 20 includes three tumbler bores 22 and additional bores 73 for receiving the pin-tumblers 71. A key 74 to operate the lock has three sets of concentric recesses 76 and two oblong recess 75 to align the ends of the pin-tumblers 71.

In view of the above-described embodiments of the invention, it can be appreciated that the pin-tumblers which do not lie in a single longitudinal plane of the cylinder 20 can be arranged to have more combinations thereof than is possible with pin-tumblers which lie in the same longitudinal plane.

With the invention thus explained, it is apparent that various modifications and variations can be made without departing from the scope of the invention. It is therefore intended that the invention be limited as indicated in the appended claims.

We claim:

1. A cylinder lock comprising, a housing, a cylindrical body mounted rotatably in said housing, at least one group of first pin-tumblers in said cylindrical body, said group of said first pin-tumblers including sub-groups of said first pin-tumblers, each of said sub-groups comprising at least one central first pin-tumbler and at least three surrounding first pin-tumblers which are adjacent side by side to each other, the axes of said first pin-tumblers lying in different parallel longitudinal planes normal to a diametrical plane of said cylindrical body, at least one group of second pin-tumblers comprising a sub-group of second pin-tumblers disposed in said housing complimentary and aligned with said first pin-tumblers and comprising at least one second central pin-tumbler and at least three second surrounding pin-tumblers, at least one group of first tumbler bores disposed in said cylindrical body, each of said first tumbler bores receiving each sub-groups of said first pin-tumblers, at least one group of second tumbler bores in said housing complimentary and aligned with said first tumbler bores, means for urging said second pin-tumblers to extend into said first bores so as to prevent rotation of said cylindrical body, said first pin-tumblers being moved into a key hole by said second pin-tumblers, and a key complimentary with said key hole and having at least one planar side on which are provided projections or recesses adapted for moving said first pin-tumblers to move in turn said second pin-tumblers out of said first bore so as to thereby permit said cylindrical body to rotate.

2. The cylinder lock as claimed in claim 1, wherein said urging means includes at least one helical spring urging each of said second pin-tumblers.

3. The cylinder lock as claimed in claim 1, wherein said urging means includes first helical springs urging said central pin-tumbler and second helical springs dispossed to surround each of said first helical springs and urges said surrounding pin-tumblers.

4. The cylinder lock as claimed in claim 3, further comprising sleeves disposed around each sub-group of said first and second pin-tumblers in a telescopic manner.

5. The cylinder lock as claimed in claim 4, wherein said urging means further comprises third helical springs each of which urges each of said sleeves.

6. The cylinder lock as claimed in claim 1, in which said lock includes more than one group of said first and second pin-tumblers, wherein the axis of each group of pin-tumblers is inclined with respect to each other.

7. The cylinder lock as claimed in claim 2, further comprising a perforated guide plate member disposed in said housing and having guiding perforations adjacent to said second tumbler bores, each of said second pin-tumblers in each sub-group passing through each of said guiding perforations.

8. The cylinder lock of claim 1 wherein said sub-group of first and second pin-tumblers further comprises at least four first and second surrounding pin-tumblers.

9. The cylinder lock of claim 1 wherein said means for urging said second pin-tumblers is a single spring.

10. The cylinder lock of claim 3 wherein said means for urging said second pin-tumblers includes a first spring to engage said second central pin-tumblers and a second spring to engage said second pin-tumblers with said first surrounding pin-tumblers wherein said second spring is coaxially disposed with respect to said first spring.

11. A cylinder lock comprising;

(a) a housing;

(b) a cylinder body mounted within said housing and comprising means defining a key hole and means defining at least one first group of bores arranged substantially perpendicular to the axis of said cylinder;

(c) at least one group of first tumblers comprising at least one first bundle of tumblers axially disposed in each of said means defining said first bores in which each tumbler in said first bundle of tumblers terminates in a rounded tip;

(d) at least one second group of second tumblers comprising at least one second bundle of tumblers disposed in means defining second bores in said housing cooperating with said first bores;

(e) means for urging said second bundle of tumblers axially toward said first bundle of tumblers to extend into said first means defining bores in the cylinder to prevent rotation of said cylinder;

(f) a key complementary with said means defining a key hole and having at least one planar side cooperating with said first group of bores, said planar side having at least one projection or recess complementary with said first bundle of tumblers adapted for moving said first bundle of tumblers within said first bore whereby said cylinder is able to rotate within said housing.

12. A cylinder lock comprising;

(a) a housing;

(b) a cylinder body mounted within said housing and comprising means defining a key hole and means defining at least one first group of bores arranged substantially perpendicular to the axis of said cylinder;

(c) at least one group of first tumblers comprising at least one first bundle of tumblers axially disposed in each of said means defining said first bores in which each tumbler in said first bundle of tumblers terminates in a rounded tip;

(d) at least one second group of second tumblers comprising at least one second bundle of tumblers disposed in means defining second bores in said housing cooperating with said first bores;

(e) means for urging said second bundle of tumblers axially towards said first bundle of tumblers to extend into said first means defining bores in the cylinder to prevent rotation of said cylinder;

(f) a key complementary with said means defining a key hole and having at least one planar side cooperating with said first group of bores, said planar side having at least one rounded recess for receiving and independently accomodating each of said rounded tips of said plurality of tumblers to move said first bundle of tumblers within said first bore whereby said cylinder is able to rotate within said housing.

13. The cylinder lock of claim 12 wherein said first and second bundles of tumblers include a first and second central tumbler encircled by first and second surrounding tumblers respectively.

14. The cylinder lock of claim 12 wherein said rounded recess on said key is circular to receive said rounded tips of said tumblers, to move each of said first bundles of tumblers in said first bores whereby said cylinder is able to rotate within said housing.

15. The cylinder lock of claim 13 wherein said rounded recess on said key is circular recess having a uniform depth to receive said surrounding first tumblers.

16. The cylinder lock of claim 12 wherein said circular recess has a uniform depth.

17. The cylinder lock of claim 11 wherein said projection or recess is annular.

* * * * *